US005505446A

United States Patent [19]

Whitaker

[11] Patent Number: 5,505,446

[45] Date of Patent: Apr. 9, 1996

[54] VARIABLE FLEX SHAFT SYSTEM FOR AN ARRAY OF GOLF CLUBS

[76] Inventor: William T. Whitaker, 1235 N. Sunnyvale St. #36, Mesa, Ariz. 85205

[21] Appl. No.: 351,732

[22] Filed: Dec. 8, 1994

Related U.S. Application Data

[63] Continuation of Ser. No. 91,721, Jul. 15, 1993, abandoned, which is a continuation of Ser. No. 599,997, Oct. 19, 1990, abandoned.

[51] Int. Cl.[6] ..... A63B 53/00

[52] U.S. Cl. ..... 273/77 A; 273/80 B

[58] Field of Search ..... 273/77 A, 80 R, 273/80 B

[56] References Cited

U.S. PATENT DOCUMENTS

| | | | |
|---|---|---|---|
| 2,250,428 | 7/1941 | Vickery | 273/80 B |
| 3,871,649 | 3/1975 | Kilshaw | 273/77 A |
| 3,963,236 | 6/1976 | Mann | 273/77 A |
| 5,093,162 | 3/1992 | Fenton et al. | 273/80 B |
| 5,163,681 | 11/1992 | Hodgetts | 273/77 A |

FOREIGN PATENT DOCUMENTS

| | | | |
|---|---|---|---|
| 206707 | 2/1957 | Australia | 273/77 A |

OTHER PUBLICATIONS

"How to Buy Equipment", Golf Digest, Mar. 1974, pp. 54–58, 273/80 B.

*Primary Examiner*—William M. Pierce

*Attorney, Agent, or Firm*—Renner, Kenner, Greive, Bobak, Taylor & Weber

[57] ABSTRACT

An array of golf clubs having individual club shafts with different flex ratings. The clubs having the longest ball striking range potential and used for golf shots wherein acute accuracy is not necessarily of prime importance are provided with the most flexible shafts. The clubs having the shortest ball striking range potential and for which accuracy is usually essential, are provided with the least flexible shafts.

4 Claims, 1 Drawing Sheet

VARIABLE FLEX SHAFT SYSTEM FOR AN ARRAY OF GOLF CLUBS

This is a continuation of application Ser. Nos. 08/091,721, filed Jul. 15, 1993, which is a continuation of application Ser. No. 07/599,997, filed Oct. 19,1990, both now abandoned.

TECHNICAL FIELD

The present invention generally relates to an array of golf clubs normally used for participating in the game of golf. More particularly, the present invention relates to an array of golf clubs having differing characteristics enabling the user to select a proper club for an individual golf shot depending upon the distance and accuracy required to make an effective play. Specifically, the present invention relates to an array of golf clubs as above, wherein the clubs are provided with differing shaft fiexibilities.

BACKGROUND OF THE INVENTION

It is known in the golfing art to provide an array of clubs for engaging in the game of golf. The clubs are sequentially configured to provide differing ball striking range potentials varying from longest distance to shortest distance due to differences therebetween in shaft length and club head face angle or "loft".

By "ball striking range potential" it is understood to refer to the potential distance that a ball will travel when struck with a given club, assuming no undue outside influence such as wind or deviations in player skill levels. For instance, it is known that the 1 wood or driver has the longest ball striking range potential, and is therefore, usually used when maximum distance for a golf shot is desired. Further, the "long irons" which usually include the 2, 3, and 4 irons have somewhat less range potential, the 5, 6 and 7 irons have medium range potential, and the short irons including the 8 and 9 irons and pitching wedge, have the shortest range potential.

It is also known in the golfing art, to provide different arrays of golf clubs, often referred to as "sets", wherein one array has clubs with one flexibility, and another array has clubs with a different flexibility. A rating system generally recognized in the art is employed using the letters X, S, R, A and L. Each letter is designated for a particular range of shaft fiexibilities, relative to the other range designations. For instance, a shaft flexibility rating of "X" is employed with the most stiff or the least flexible club shafts. A rating of "S" denotes a somewhat more flexible shaft than a shaft with an "X" rating, and ratings of "R" and "A" indicate successively and respectively more flex than the immediate predecessor rating. A shaft flexibility rating of "L" is provided for shafts having the most flexibility. As is known to those skilled in the art, the flexibility rating of a golf shaft is quantified by a system measuring shaft deflection as a function of shaft length and applied force.

The effect of shaft flexibilities on golf shots is well known. A more flexible shaft, such as the shafts in the A or L range, will provide a greater ball striking range potential than a more stiff shaft such as in the S or X range when the same swing or striking force is applied. However, it is also known that a more flexible shaft will impart a potential for poorer accuracy on a given golf shot when compared to a similar shot made with a club having a stiffer shaft.

With a more powerful swing, there is greater distortion of the shaft during the swing, and the less chance there is for the club head to return to its proper position with relation to the ball at the point of impact. With a very powerful swing, even an "X" shaft will flex. This will provide the boost of power that is achieved by less powerful swings by using a more flexible shaft.

Heretofore it has been the standard practice in the art to determine a player's skill level and then provide an array of golf clubs having one shaft flexibility rating for all clubs in the array, suited to that player. For instance, if the player is a skilled golfer, having a consistently accurate and powerful swing, the player will often select an array of clubs having an S or X shaft flex rating. The criterion for accuracy is often considered more important than that for sheer distance on a given shot. This rationale is true when it is considered that, at most, the first or second golf shots on a given hole will be made for sheer distance, while each succeeding shot will be played for as much accuracy as possible. The necessity for accuracy typically increases with each successive shot played.

If the player is not particularly skilled, or if the player usually has a less powerful swing, then distance becomes a more important consideration. This player may choose an array of clubs having an L or A rating, hoping to equip himself with as much ball striking range potential as possible.

This approach to equipping golfers has proven to have severe drawbacks. For instance, the skilled player may benefit from the increased accuracy on the short iron shots, but because the clubs have stiff shafts, distance is sacrificed on the longer shots. Similarly, the less skilled or less powerful player may benefit from extra yardage on longer shots, but accuracy is lost on the short irons, just at the time when it is most needed. Again, the distortion of the shaft during the swing means that there is less of a chance that the club head will be properly aligned at the point of impact with the ball.

Therefore, a need exists for an array of golf clubs which will take advantage of shaft flexibilities on long, intermediate and short golf shots.

DISCLOSURE OF THE INVENTION

It is therefore, an object of the present invention to provide an improved array of golf clubs.

It is a further object of the present invention to provide an array of golf clubs as above, which will advantageously capitalize upon shaft flexibilities.

It is another object of the present invention to provide an array of golf clubs as above, which will provide a maximum ball striking range potential for golf shots requiring maximum distance, and which will provide a maximum of accuracy potential for a golf shot requiring maximum accuracy.

In general, the invention is directed toward an array of golf clubs of the type having a plurality of clubs sequentially configured to provide differing ball striking range potentials varying from longest distance to shortest distance due to differences therebetween in shaft length and club head loft. The improvement in this array of clubs comprises providing each club of the array with a preselected shaft having a flexibility determined by the specific ball striking range potential of each club and at least two of the plurality of clubs having shafts with differing flexibilities.

Also, an array of golf clubs comprises a plurality of clubs each sequentially configured to provide differing ball striking range potentials varying from longest distance to shortest distance. Further, each club of the plurality of clubs has a grip portion, a shaft and a club head. At least two of the clubs have different shaft flexibilities.

A preferred variable flex shaft system for an array of golf clubs incorporating the concepts of the present invention is shown by way of example in the accompanying drawing without attempting to show all the various forms and modifications in which the invention might be embodied, the invention being measured by the appended claims and not by the details of the specification.

BRIEF DESCRIPTION OF THE DRAWINGS

For a complete understanding of the objects, techniques, and structure of the invention, reference should be made to the following detailed description and accompanying drawings.

BEST MODE FOR CARRYING OUT THE INVENTION

Figure 2:
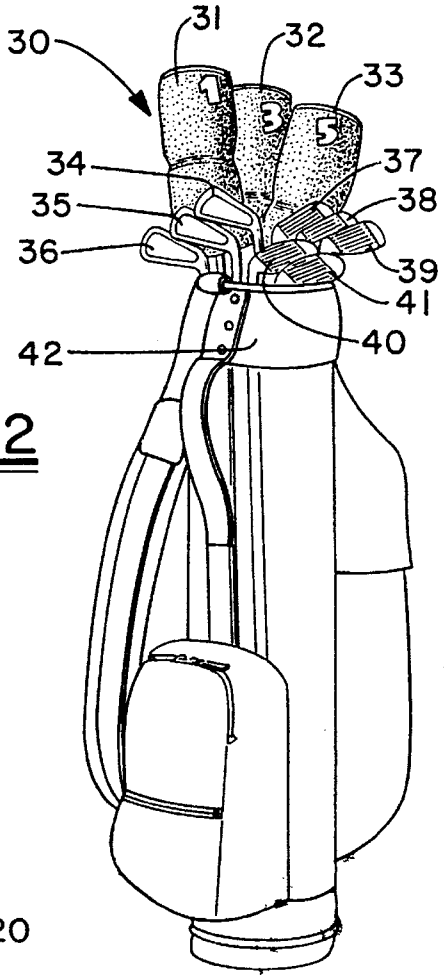
FIG. 2 depicts an array of golf clubs according to the present invention.

A standard golf club is depicted upon the accompanying drawing by the numeral 10. The club 10 includes a grip portion 11, a shaft 12, and a club head 13. Club 10 may be any of the clubs normally employed during a round of golf which, as stated above, include woods and irons. Woods may include the 1 wood or driver, as well as 2 through 8 or higher. Similarly, irons may include 1 through 9 or higher, as well as pitching wedges, sand wedges or the like. As is known in the art, some woods, such as the 5 wood and higher numbered woods, may have a lower ball striking range potential than some of the long irons. A number of the different clubs 10 will make up an array or set.

The differences between one club 10 and another, is due to various combinations of changes in shaft length and club head loft. Club 10 is a depiction of any and all of these different combinations which are known in the art.

Figure 1:
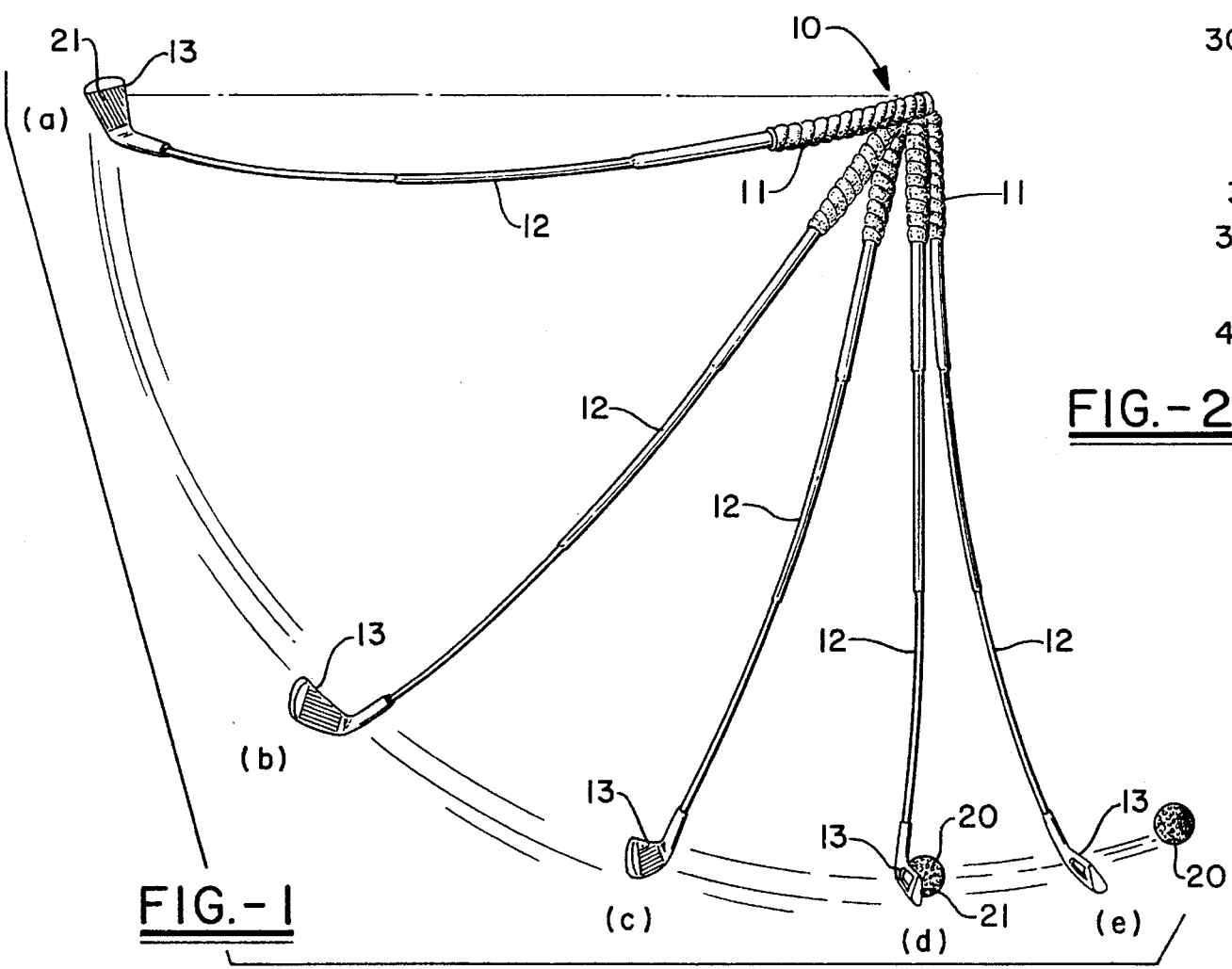
FIG. 1 depicts a typical shaft flex at various points during the down stroke of a golf swing.

Club shaft 12 of a given array will also vary in flexibility between clubs 10 of another array. As shown in FIG. 1, during the golf stroke, shaft 12 flexes during the swing. At the position marked as "a" in FIG. 1, at the initiation of the downstroke, shaft 12 is flexed due to the forces generated during the stroke. At the position marked as "d", the golf ball 20 is struck by the face 21 of club head 13, and in the position marked as "e" shaft 12 is shown to spring back to a flex opposite that as in the position "a", providing a "kick" to the ball 20, providing extra power to the golf stroke, and hence, adding extra distance to the ball's flight.

Heretofore, it has been known to provide an entire array or set of clubs having a single shaft flexibility. By considering the accuracy and ball striking range potentials of a given club 10, the present invention effects an array of golf clubs 10, wherein each club 10 is provided with a shaft flexibility suited to the actual power and skill of the user and suited to the ball striking range potential of the club 10 itself.

A typical array of golf clubs 30 is shown in FIG. 2. Array 30 includes a driver 31, a 3 wood 32, a 5 wood 33, a 3 iron 34, a 4 iron 35, a 5 iron 36, a 6 iron 37, a 7 iron 38, an 8 iron 39, a 9 iron 40 and a pitching wedge 41. Array of golf clubs 30 is depicted in FIG. 2, as being positioned within a golf bag 42, in order to better depict the environment.

Generally, the present invention makes use of the longer ball striking range potential of a more flexible shaft when selecting a club shaft 12 for a club 10 wherein maximum distance is the objective. For instance, with the woods and particularly with the driver, it is desired to have a club 10 which will provide the most distance possible for a given shot. Accuracy with the first shot on a given golf hole is not the most critical requirement. If the golfer merely keeps the shot in the fairway, then most often the shot will be considered acceptable. At these times however, maximum distance is sought. Therefore, an array of golf clubs according to the present invention will be provided with woods having shaft flexibilities in the range of S for highly skilled and powerful golfers; in the range of about R and A for golfers who are above average in skill and/or power; in the range of about A for golfers who are average in skill and/or power; and in the range or L for the golfers able to provide much less power or having less skill who are below average in skill and/or power.

Similarly, for the long irons a more stiff shaft will be chosen, such as in the S, R or A range. With the long irons, the golfer is usually aiming at the green, and not just at the fairway. Therefore, while it is still desired to have a maximum of ball striking range potential, accuracy becomes a more important objective than with the initial tee shot. The stiffer shaft 12 will provide for more accuracy during the shot.

The short irons are generally called upon to provide the most accuracy of any of the shots made while not actually on the green. Often, these shots are aimed directly at the hole, with the intention of not just getting the ball 20 onto the green, but actually sinking it in the hole. Therefore, the short irons will require a maximum of accuracy and not necessarily a maximum of ball striking range potential. Therefore, an array of clubs according to the invention provides short irons having the most stiff shafts 12, and hence the most potential for accuracy of any of the clubs 10 within the array. The shafts will have for instance, a flex rating of about X, S or R.

It is to be understood that what is considered to be a "stiff" shaft 12 for one golfer, may be a flexible one for another, depending upon the relative power and skill possessed by the individual golfers. Therefore, one skilled in the art will select a proper shaft 12 having the correct flexibility for a golfer's power and skill level, by applying the concepts of the invention as disclosed herein. Hence, one golfer may have an array of clubs 10 according to the present invention wherein the driver of the array has a shaft flex rating of R, while another may have another array of clubs 10 according to the present invention having a driver with a shaft flex rating of L.

A golfer with a powerful swing and improper technique might be provided with a stiffer shaft for the woods and long irons, perhaps in the range of an S rated shaft. This will provide more accuracy to the golf shot without losing too much in the way of distance due to this golfer's powerful swing. An X shaft may be selected for this golfer's medium and short irons.

As will be appreciated, an array of golf clubs according to the present invention will be provided based upon the relative power and skill of the golfer employing the array.

GENERAL EXPERIMENTAL

In order to demonstrate the actual usefulness of the present invention, four arrays of clubs 10 were developed. It is understood that these actual examples are not in themselves limitations of the present invention, and are only included in order to show the utility of the invention.

Example No. 1

An array of clubs was developed according to the above disclosure for a male golfer having an above average degree of power and skill, and is reported in TABLE I. In order to provide a degree of relevance to what is meant by a "degree", the golfer for Example 1 is considered to have a handicap of between 12 and 18. Handicapping is recognized by those knowledgeable in the art as a means for determining the skill level of a given player.

TABLE I

| Club | Shaft Flex |
|---|---|
| | Rating |
| Driver | R |
| 3 Wood | R |
| 5 Wood | R |
| 3 Iron | S |
| 4 Iron | S |
| 5 Iron | S |
| 6 Iron | X |
| 7 Iron | X |
| 8 Iron | X |
| 9 Iron | X |
| Wedge | X |

Example No. 2

In Example 2, the golfer is an average golfer having somewhat less power and/or skill than the golfer of Example 1, and has a handicap of about 18–24. Therefore, the golfer of Example No. 2 will require assistance in obtaining maximum distance with the initial shot, and hence, a more flexible shaft is selected for the woods and long irons than with the golfer's array in Example 1. The array according to the present invention for the golfer in Example No. 2 is reported in TABLE II.

TABLE II

| Club | Shaft Flex |
|---|---|
| | Rating |
| Driver | A |
| 3 Wood | A |
| 5 Wood | A |
| 3 Iron | R |
| 4 Iron | R |
| 5 Iron | R |
| 6 Iron | S |
| 7 Iron | S |
| 8 Iron | S |
| 9 Iron | X |
| Wedge | X |

Example No. 3

In Example No. 3, the golfer is one having much less power than either golfer of Example Nos. 1 or 2, such as a female golfer, or the golfer is one having much less skill. This golfer's handicap is likely to be about 24 or higher. Therefore, maximum distance is a consideration for all but the closest of golf shots for this golfer. The array of clubs selected according to the present invention is tabulated in TABLE III.

TABLE III

| Club | Shaft Flex |
|---|---|
| | Rating |
| Driver | L |
| 3 Wood | L |
| 5 Wood | L |
| 3 Iron | A |
| 4 Iron | A |
| 5 Iron | A |
| 6 Iron | R |
| 7 Iron | R |
| 8 Iron | R |
| 9 Iron | S |
| Wedge | S |

Example No. 4

In Example No. 4, the golfer is one having exceptional power and skill, such as one having a handicap under 12. This array is reported in TABLE IV.

TABLE IV

| Club | Shaft Flex |
|---|---|
| | Rating |
| Driver | S |
| 3 Wood | S |
| 5 Wood | S |
| 3 Iron | S |
| 5 Iron | S |
| 6 Iron | X |
| 7 Iron | X |
| 8 Iron | X |
| 9 Iron | X |
| Wedge | X |

It should thus be evident that an array of golf clubs having variable flex ratings within the array is accomplished by the invention as disclosed above. Thus the invention disclosed herein and defined by the following claims accomplishes the objects of the present invention and otherwise constitutes an advantageous contribution to the art.

I claim:

1. In an array of golf clubs, of the type having a plurality of clubs sequentially configured to provide differing ball striking range potentials varying from longest distance to shortest distance due to differences therebetween in shaft length and club head loft, the improvement comprising:

providing each club of the array with a preselected shaft having a flexibility rating determined by the specific ball striking range potential of each club and at least two of the plurality of clubs having shafts with differing flexibility ratings, the club having the longest ball striking range potential provided with a shaft having the highest flexibility rating in the array and the club having the shortest ball striking range potential provided with a shaft having the lowest flexibility rating in the array and wherein the plurality of clubs includes a 1 wood, 3 wood, 5 wood, 3 iron, 4 iron, 5 iron, 6 iron, 7 iron, 8 iron, 9 iron and a pitching wedge, and said 1 wood, said 3 wood and said 5 wood having a shaft flexibility rating of A; said 3 iron, said 4 iron and said 5 iron have a shaft flexibility rating of R; said 6 iron, said 7 iron and said 8 iron have a shaft flexibility rating of S; and said 9 iron and said pitching wedge have a shaft flexibility of X.

2. In an array of golf clubs, of the type having a plurality of clubs sequentially configured to provide differing ball striking range potentials varying from longest distance to shortest distance due to differences therebetween in shaft length and club head loft, the improvement comprising:

providing each club of the array with a preselected shaft having a flexibility rating determined by the specific ball striking range potential of each club and at least two of the plurality of clubs having shafts with differing flexibility ratings, the club having the longest ball striking range potential provided with a shaft having the highest flexibility rating in the array and the club having the shortest ball striking range potential provided with a shaft having the lowest flexibility rating in the array and wherein the plurality of clubs includes a 1 wood, 3 wood, 5 wood, 3 iron, 4 iron, 5 iron, 6 iron, 7 iron, 8 iron, 9 iron and a pitching wedge, and said 1 wood, said 3 wood and said 5 wood having a shaft flexibility rating of R; said 3 iron, said 4 iron and said 5 iron have a shaft flexibility rating of S; said 6 iron, said 7 iron, said 8 iron, said 9 iron and said pitching wedge have a shaft flexibility of X.

3. In an array of golf clubs, of the type having a plurality of clubs sequentially configured to provide differing ball striking range potentials varying from longest distance to shortest distance due to differences therebetween in shaft length and club head loft, the improvement comprising:

providing each club of the array with a preselected shaft having a flexibility rating determined by the specific ball striking range potential of each club and at least two of the plurality of clubs having shafts with differing flexibility ratings, the club having the longest ball striking range potential provided with a shaft having the highest flexibility rating in the array and the club having the shortest ball striking range potential provided with a shaft having the lowest flexibility rating in the array and wherein the plurality of clubs includes a 1 wood, 3 wood, 5 wood, 3 iron, 4 iron, 5 iron, 6, iron, 7 iron, 8 iron, 9 iron and a pitching wedge, and said 1 wood, said 3 wood and said 5 wood having a shaft flexibility rating of L; said 3 iron, said 4 iron, said 5 iron have a shaft flexibility rating of A; said 6 iron, said 7 iron, and said 8 iron have a shaft flexibility rating of R; and said 9 iron and said pitching wedge have a shaft flexibility of S.

4. In an array of golf clubs, of the type having a plurality of clubs sequentially configured to provide differing ball striking range potentials varying from longest distance to shortest distance due to differences therebetween in shaft length and club head loft, the improvement comprising:

providing each club of the array with a preselected shaft having a flexibility rating determined by the specific ball striking range potential of each club and at least two of the plurality of clubs having shafts with differing flexibility ratings, the club having the longest ball striking range potential provided with a shaft having the highest flexibility rating in the array and the club having the shortest ball striking range potential provided with a shaft having the lowest flexibility rating in the array and wherein the plurality of clubs includes a 1 wood, 3 wood, 5 wood, 3 iron, 4 iron, 5 iron, 6, iron, 7 iron, 8 iron, 9 iron and a pitching wedge, and said 1 wood, said 3 wood and said 5 wood, said 3 iron, said 4 iron, and said 5 iron having a shaft flexibility rating of S; and said 6 iron, said 7 iron, said 8 iron, said 9 iron and said pitching wedge have a shaft flexibility of rating X.

* * * * *